United States Patent [19]

Corwin

[11] 4,262,924

[45] Apr. 21, 1981

[54] HINGE SKI

[76] Inventor: Charles H. Corwin, Box 689, Ketchum, Id. 83340

[21] Appl. No.: 12,224

[22] Filed: Feb. 14, 1979

[51] Int. Cl.[3] ..... A63C 5/02

[52] U.S. Cl. ..... 280/603

[58] Field of Search ..... 280/603, 615, 601, 602, 280/606, 607, 615

[56] References Cited

U.S. PATENT DOCUMENTS

| | | | |
|---|---|---|---|
| 2,260,057 | 10/1941 | Rydberg | 280/603 |
| 2,367,528 | 1/1945 | Rollins | 280/603 |
| 3,884,315 | 5/1975 | Fox | 280/603 |
| 4,125,273 | 11/1978 | Rothmayer | 280/603 |

*Primary Examiner*—John J. Love
*Assistant Examiner*—Michael Mar
*Attorney, Agent, or Firm*—Harvey B. Jacobson

[57] ABSTRACT

A ski construction for cross-country skiing is provided including front and rear tandem ski sections pivotally joined together by an offset hinge at their adjacent ends for relative angular displacement about a transverse axis closely adjacent the undersurfaces of the sections between predetermined first positions with the undersurfaces substantially coplanar and variable second positions with the longitudinal undersurfaces defining an included angle greater than 180°. Spring structure is operatively connected between the sections for yieldingly biasing the sections from the variable second positions toward the predetermined first positions and is in the form of a straight structural brace bracing the ski sections against angular displacement toward the second positions. The spring must be laterally deflected intermediate its opposite ends from the static brace defining straight position thereof to allow angular displacement of the ski sections toward the variable second positions. Ski boot binding structure is operatively associated with the spring in a manner such that downward toe pressure by an associated ski boot is operative to laterally deflect the midportion of the spring structure enabling the ski sections to be displaced toward their variable second positions. All moving parts subject to snow and ice buildup are protected by a flexible covering. The offset hinge serves as a rearward facing step which in conjunction with the deflected ski provides surfaces against which the skier can thrust to gain forward movement. Additionally, the offset hinge allows the ski to be folded.

13 Claims, 10 Drawing Figures

HINGE SKI

BACKGROUND OF THE INVENTION

Various forms of folding skis and knockdown skis have been heretofore designed and other forms of skis have been provided with retractable undersurface projections for use in braking and also for use in moving forwardly up a slope, the projections, when extended, acting as brakes to prevent rearward sliding of the skis. Examples of various forms of these types of skis are disclosed in U.S. Pat. Nos. 2,224,897, 2,302,478, 3,332,404, 2,791,435, 3,689,093 and 3,873,108.

However, when it is desired to engage in cross-country skiing, common practice dictates the use of carefully applied special waxes to the undersurfaces of the skis or the use of special skis with "fish scale" bottoms or mohair strips which mainly comprise the grouping known as "no wax" skis. The various current forms of "no wax" skis reduce the ability of the skis to slide forwardly with minimum resistance and the use of special waxes is time consuming and has the disadvantage that even carefully applied special waxes loose their efficiency after short periods of use.

Accordingly, a need exists for a ski which may be efficiently, comfortably and pleasurably used for cross-country skiing.

BRIEF DESCRIPTION OF THE INVENTION

The hinge ski of the instant invention utilizes a pair of tandem ski sections pivotally joined together at their adjacent ends for relative angular displacement about a transverse axis closely adjacent the undersurfaces of the ski sections and with the ski sections being relatively angularly displaceable between first positions with the undersurfaces thereof substantially coplanar and second positions with the undersurfaces defining and included angle of greater than 180°. An upper elongated straight leaf spring is anchored between the tandem ski sections with the midportion of the leaf spring bridging the hinge joint between the ski sections and, therefore, constitutes a brace connection between the ski sections preventing relative angular displacement thereof from the predetermined first positions toward the variable second positions. However, the ski construction includes a ski boot binding structure whose ski boot toe anchoring portion is operatively associated with the midportion of the leaf spring in a manner such that the transfer of an adjustable amount of toe weight to the ski boot binding structure will result in at least initial downward lateral deflection of the leaf spring substantially reducing its bracing resistance to angular displacement of the ski sections from the first predetermined positions toward the variable second positions and thereby enabling such angular displacement of the ski sections. With the ski sections angularly displaced in the variable second positions said sections act as a wide angled wedge. The angle of the wedge, which is equal to the angle of the variable second positions, is governed up to the mechanical limit of the variable second positions by the compressability of the snow. The more compressable the snow conditions the greater the included angle of the ski sections. In relatively compressable snow conditions said wedge provides practically the whole bottom of the ski, both sections, as a surface against which the skier can thrust in order to gain forward movement. Additionally, the adjacent undersurface portions of the ski sections are positioned relative to each other so as to define a rearwardly facing step at the rear end of the forward ski section and which step, upon angular displacement of the ski section from the predetermined first positions thereof to the variable second positions thereof, is exposed and extended for increased tractional engagement with the underlying ice or snow to also resist rearward movement of the ski construction, particularly in hardpacked snow or icy conditions. This capability along with the aforementioned wedge action results in a ski that automatically adapts to practically every snow condition to provide a resistance against which the skier can thrust in order to gain forward movement.

All moving parts of the ski that would be rendered inoperative by ice and snow buildup are protected from same by a flexible covering.

The main object of this invention is to provide a ski construction particularly well adapted for cross-country skiing.

Another object of this invention is to provide a cross-counry ski which may also be folded to allow compact storage and transport thereof.

Yet another object of this invention is to provide a cross-country ski which will be usable in the conventional manner in pleasure skiing not involving cross-country skiing.

Still another important object of this invention is to provide a new and different form of "no wax" ski which will not require the special waxing customarily associated with cross-country skis and which will further not require the use of "fish scale" bottoms or mohair strips.

A further very important object of this invention is to provide a ski construction enabling ready replacement of either the front or rear section thereof in the event of ski damage which would normally render a conventional ski totally unsalvageable.

A final object of this invention to be specifically enumerated herein is to provide a ski construction in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates the ski construction of the instant invention. The ski 10 includes front and rear tandem ski sections 12 and 14 and it may be considered that the ski sections 12 and 14 usually include coextensive undersurfaces 16 and 18 which are substantially coplanar, at least at their adjacent ends, when the sections are in their predetermined first positions.

Figure 1:
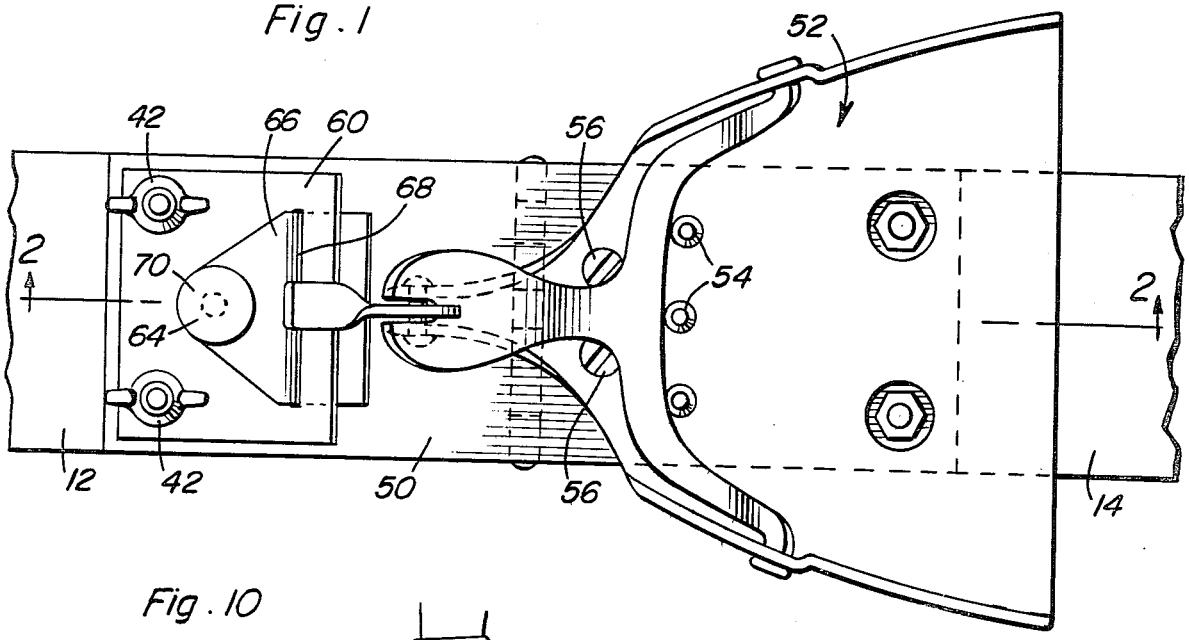
FIG. 1 is a fragmentary top plan view of the longitudinal mid-portion of a ski constructed in accordance with the present invention.
Figure 10:
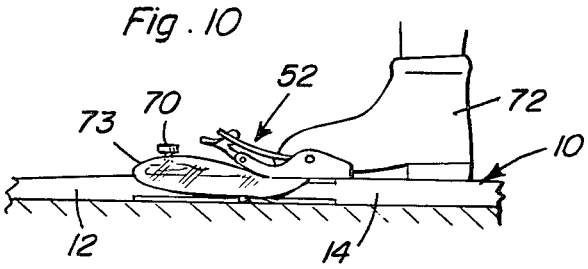
FIG. 10 is an enlarged fragmentary side elevational view illustrating a flexible waterproof cover applied over the relatively movable components of the invention to prevent the buildup of ice thereon.
Figure 2:
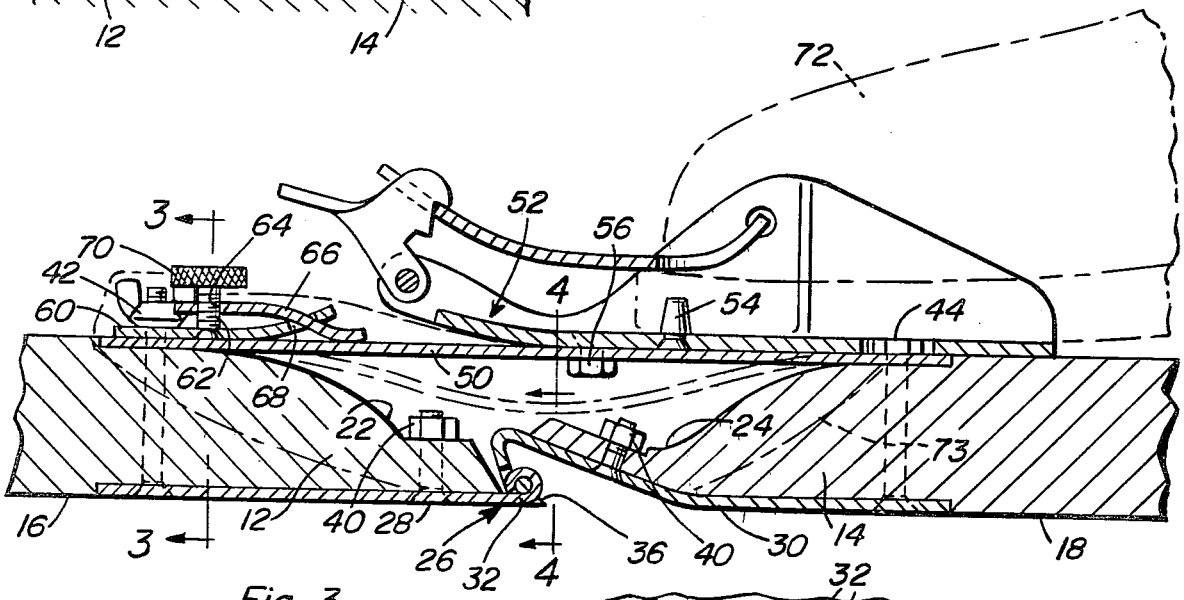
FIG. 2 is a longitudinal vertical sectional view of the assemblage illustrated in FIG. 1.
Figure 3:
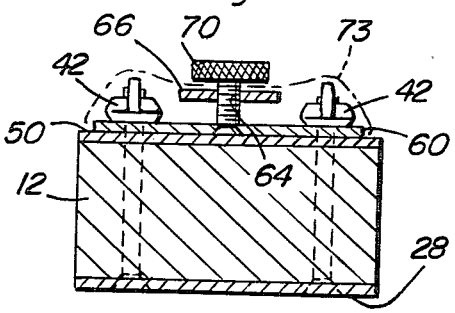
FIG. 3 is a transverse sectional view taken substantially upon the plane indicated by the section line 3—3 of FIG. 2.
Figure 4:
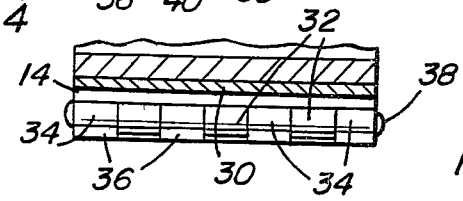
FIG. 4 is a fragmentary transverse vertical sectional view taken substantially upon the plane indicated by the section line 4—4 of FIG. 2.
Figure 5:
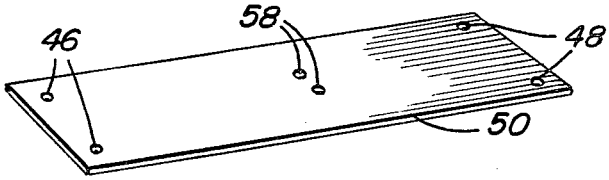
FIG. 5 is a perspective view of the leaf spring utilized in the construction of the ski.

The adjacent ends of the ski sections 12 and 14 are relieved in upper areas thereof as at 22 and 24 and an offset leaf hinge assembly referred to in general by the reference numeral 26 and including front and rear pivotally joined leaves 28 and 30 pivotally interconnects the adjacent ends of the sections 12 and 14 in the manner illustrated in FIG. 2. The leaves 28 and 30 are seated in mortises formed in the adjacent undersurface portions of the sections 12 and 14 and the leaf 28 includes multiple rolled hinge barrel portions 32 while the hinge leaf 30 includes multiple axially spaced hinge barrel portions 34, the leaf hinge 28 including rearwardly facing ice and snow teeth 36 aligned with the hinge barrel portions 34. Of course, the hinge barrel portions 32 are received between and axially aligned with the hinge barrel portions 34 and a hinge pin 38 is secured through the hinge barrel portions 32 and 34. Suitable fasteners 40 are utilized to secure the adjacent portions of the hinge leaves 28 and 30 to the ski sections 12 and 14 and fasteners 42 and 44 are utilized to secure the remote ends of the hinge leaves 28 and 30 to the ski sections 12 and 14, the fasteners 42 and 44 being received through apertures 46 and 48, respectively, formed in the opposite ends of an elongated flat leaf spring 50 whose opposite ends are anchored in mortises formed in the upper surfaces of the adjacent ends of the ski sections 12 and 14.

A slightly modified conventional ski binding assembly referred to in general by the reference numeral 52 and including binding pins 54 is secured, intermediate its opposite ends, to the midportion of the leaf spring 50 by fasteners 56 secured through the ski binding assembly 52 and a central pair of apertures 58 formed in the longitudinal midportion of the leaf spring 50.

The fasteners 42 not only secure the forward end of the leaf spring 50 to the rear end of the front ski section 12 but also serve to clamp a support plate 60 to the forward ski section 12 in overlying relation to the front end of the leaf spring 50. The support plate 60 rotatably supports the lower end of an upstanding adjustment screw 62 therefrom and the adjustment screw 62 is threaded through a bore 64 formed in one end of a rocker plate 66 whose midportion passes through an aperture 68 formed in the support plate 60. The other end of the rocker plate 66 bears downwardly upon the forward end portion of the leaf spring 50 overlying the relieved portion of the rear end of the forward ski section 12 and the upper end of the adjustment screw 62 includes a finger engageable knob 70. Accordingly, the knob 70 may be turned to cause vertical adjustment of the forward end of the rocker plate 66 and when the forward end of the rocker plate 66 is elevated the rear end thereof is depressed to adjust the extent of the potential upward deflection of the underlying portion of the spring 50. Also, the knob 70 may be turned to at least slightly initially downwardly laterally deflect the underlying portion of the leaf spring 50. Thus, the knob 70 may be adjusted to determine the amount of vertical pressure required to effect initial lateral deflection of the leaf spring 50.

Figure 7:
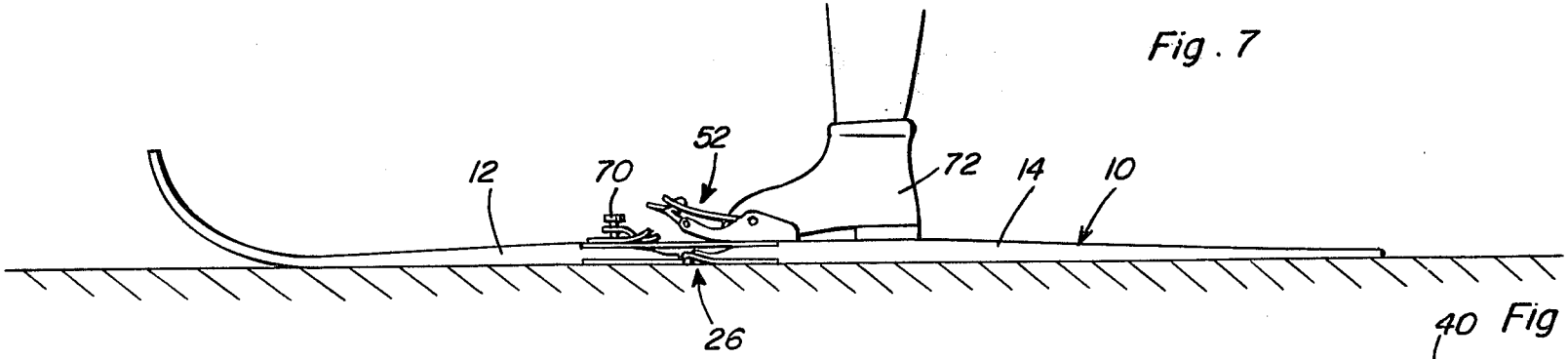
FIG. 7 is a side elevational view of the ski as it is in use with downward pressure applied thereto from the associated ski boot and with the downward ski boot pressure applied substantially evenly along the length of the ski boot.
Figure 9:
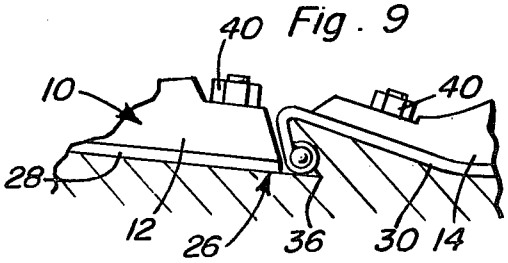
FIG. 9 is an enlarged fragmentary side elevational view of the hinge joint and adjacent ski sections of the ski illustrated in FIG. 8.
Figure 8:
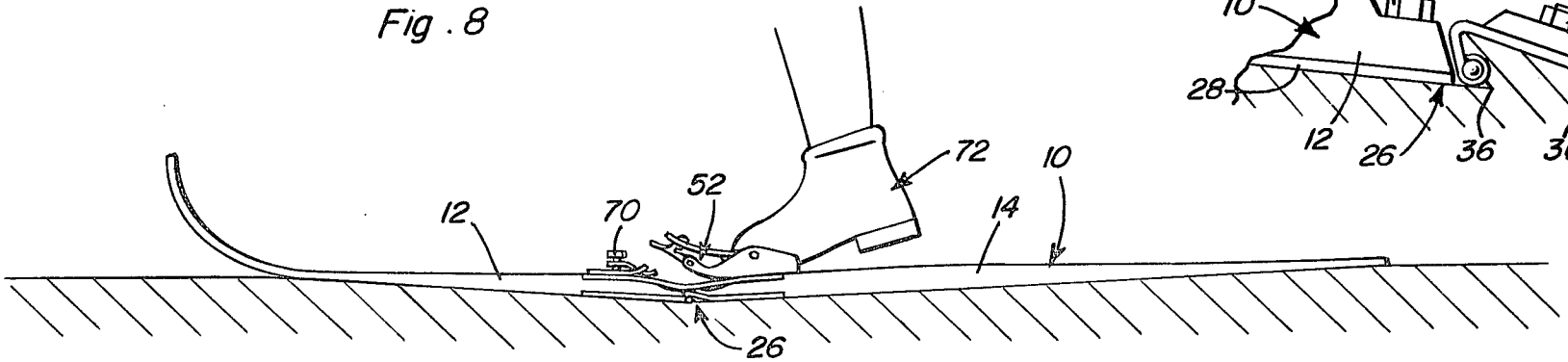
FIG. 8 is a side elevational view of the ski as it is in use with downward pressure applied thereto from the toe of the associated ski boot.

It may be seen from FIG. 2 of the drawings that the leaf spring 50, when in a straight condition, comprises a substantially rigid brace between the upper surface portions of the adjacent ends of the ski sections 12 and 14. Accordingly, relative angular displacement between the sections 12 and 14 is prevented. However, when a ski boot 72 anchored to the ski construction 10 by the binding assembly 52 has weight transferred to the toe portion thereof and the weight transferred to the toe portion of the ski boot 72 bears downwardly upon the immediately underlying portion of the binding assembly 52 and thus the spring 50, the spring 50 is downwardly laterally bowed from the position thereof illustrated in solid lines in FIG. 2 toward the position thereof illustrated in phantom lines in FIG. 2. When the midportion of the leaf spring 50 is downwardly bowed as illustrated in phantom lines in FIG. 2, the effective distance between the pairs of apertures 46 and 48 is reduced thus causing the ski sections 12 and 14 to be relatively angularly displaced about the hinge pin 38 to the variable second positions thereof above referred to and illustrated in FIG. 8 wherein the undersurfaces 16 and 18 of the ski sections 12 and 14 define an included angle greater than 180°. Thus, the ski construction 10 is transformed from either the positions thereof illustrated in FIGS. 6 and 7 of the drawings to the position thereof illustrated in FIG. 8 wherein the bottom of the ski may act as a wide angled wedge. The angle of the wedge is within the mechanical limits of the variable second positions and dependent upon the compressability of the snow surface. The wedge, with the edges 36, bites into the underlying ice and/or snow to prevent rearward movement of the ski construction 10.

Figure 6:
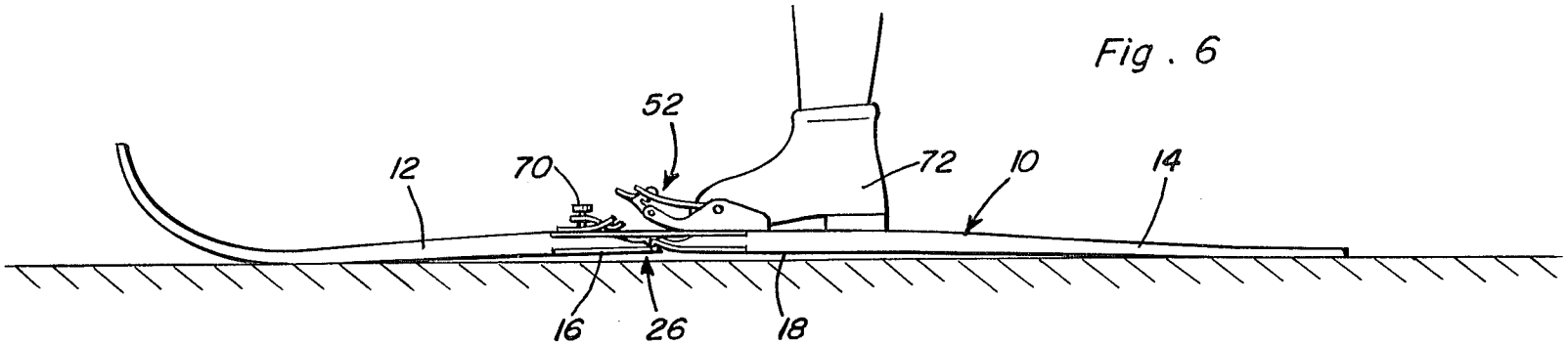
FIG. 6 is a side elevational view of the ski as it is in use without downward pressure applied thereto from the associated ski boot.

Inasmuch as the ski sections 12 and 14 are conventionally constructed, other than being pivotally joined together at adjacent ends, they may naturally flex to some extent and assume the relative positions thereof illustrated in FIG. 6 when no downward pressure is applied to the ski construction 10 by the ski boot 72. However, when substantially even downward pressure is applied to the ski construction 10 by the ski boot 72 throughout the length of the ski boot 72, the ski construction 10 assumes the condition thereof illustrated in FIG. 7. Thereafter, as the downward force applied to the ski construction 10 from the ski boot 72 is transferred to the toe of the ski boot 72, the ski construction 10 assumes the condition thereof illustrated in FIG. 8 wherein the sections 12 and 14 form a wedge, the angle of which depends upon the mechanical limits of the variable second positions and the compressability of the snow, coacting with the edges 36 to prevent rearward movement of the ski construction 10 relative to the ice or snow surface upon which it is disposed.

The adjusting screw 62 and knob 70 may be adjusted to limit the upward extent of deflection of the leaf spring 50 and even to initially slightly laterally deflect the leaf spring 50 from its static straight condition defining a rigid brace between the upper surfaces of the adjacent ends of the ski sections 16 and 18. Thus knob 70 may be adjusted to determine the amount of vertical force required to effect initial lateral deflection of the leaf spring 50. Accordingly, downward toe pressure on the ski binding assembly 52 may, sooner or later, effect angular displacement of the ski sections 12 and 14 from the first positions thereof illustrated in FIG. 7 to the second positions thereof illustrated in FIG. 8.

All moving parts associated with the spring 50 and hinge action are substantially fully protected from ice and snow buildup by a flexible covering 73.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A ski construction that automatically adjusts to varying surface conditions of ice and snow to prevent rearward movement of the ski during cross-country and uphill skiing, said ski construction including front and rear randem ski sections having substantially coextensive longitudinal undersurfaces, pivot means pivotally joining said sections together at their adjacent ends for relative angular displacement about a single, fixed transverse axis closely adjacent the rear extremity of the undersurface of the rear end of said front section and between predetermined first positions with said undersurfaces substantially coplanar and variable second positions with the adjacent portions of said longitudinal undersurfaces defining an included angle greater than 180°, said ski construction including spring means operatively connected between said sections yieldingly biasing said sections from said variable second positions toward said predetermined first positions, the rear extremity of said undersurface of said front section defining rearwardly facing edge means for engagement with ice and hard packed snow, the forward end of said rear ski section including a forwardly and upwardly inclined under-surface forward terminal end immediately rearward of said axis, ski boot binding structure supported from said rear ski section and including a toe portion thereof for support of the toe portion of an associated ski boot, said portion of said boot binding structure being disposed in vertically spaced relation over said inclined undersurface forward terminal end, whereby downward toe pressure upon rearward thrusting of the leg of a skier will result in said undersurfaces defining an included angle greater than 180° and said rearwardly facing edge means will be inclined rearwardly and downwardly relative to the direction of possible rearward sliding of said rear ski section on a supportive snow surface.

2. A ski construction that automatically adjusts to varying surface conditions of ice and snow to prevent rearward movement of the ski during cross-country and uphill skiing, said ski construction including front and rear tandem ski sections having substantially coextensive longitudinal undersurfaces, pivot means pivotally joining said sections together at their adjacent ends for relative angular displacement about a transverse axis closely adjacent said undersurfaces between predetermined first positions with said undersurfaces substantially coplanar and variable second positions with the adjacent portions of said longitudinal undersurfaces defining an included angle greater than 180° , said ski construction including spring means operatively connected between said sections yieldingly biasing said sections from said variable second positions toward said predetermined first positions, said pivot means including multiple knuckle offset leaf hinge forming a rearward facing step and providing a rigid connection between the two ski sections in the vertical transverse plane.

3. The combination of claim 2 wherein the offset hinge includes means enabling the ski to be folded for ease of transport and storage.

4. The combination of claim 2 wherein the forward end portion of the undersurface of the rear ski section is upwardly offset and the undersurface of the rear end of the front ski section defines a rearwardly facing step.

5. The combination of claim 2 including a flexible covering supported from said ski construction adjacent said pivot means and covering, at least substantially, said spring means from above to thereby protect said spring means against the buildup of ice thereon.

6. A ski construction that automatically adjusts to varying surface conditions of ice and snow to prevent rearward movement of the ski during cross-country and uphill skiing, said ski construction including front and rear tandem ski sections having substantially coextensive longitudinal undersurfaces, pivot means pivotally joining said sections together at their adjacent ends for relative angular displacement about a transverse axis closely adjacent said undersurfaces between predetermined first positions with said undersurfaces subtantially coplanar and variable second positions with the adjacent portions of said longitudinal undersurfaces defining an included angle greater than 180°, said ski construction including spring means operatively connected between said sections yieldingly biasing said sections from said variable second positions toward said predetermined first positions, the forward end portion of the undersurface of the rear ski section being upwardly offset and the undersurface of the rear end of the front ski section defining a rearwardly facing step, the rearwardly facing step incorporating a hard sharp surface for engaging ice and hard snow.

7. A ski construction that automatically adjusts to varying surface conditions of ice and snow to prevent rearward movement of the ski during cross-country and uphill skiing, said ski construction including front and rear tandem ski sections having substantially coextensive longitudinal undersurfaces, pivot means pivotally joining said sections together at their adjacent ends for relative angular displacement about a transverse axis closely adjacent said undersurfaces between predetermined first positions with said undersurfaces substantially coplanar and variable second positions with the adjacent portions of said longitudinal undersurfaces defining an included angle greater than 180°, said ski construction including spring means operatively connected between said sections yieldingly biasing said sections from said variable second positions toward said predetermined first positions, said spring means comprising an elongated generally straight leaf spring extending and secured between said sections above said axis and which is substantially straight when said sections are in said predetermined first positions and comprising a compression brace between said sections against relative angular displacement thereof from said predetermined first positions toward said variable second position and which must be bowed to allow the last mentioned relative angular displacement.

8. A ski construction that automatically adjusts to varying surface conditions of ice and snow to prevent rearward movement of the ski during cross-country and uphill skiing, said ski construction including front and rear tandem ski sections having substantially coextensive longitudinal undersurfaces, pivot means pivotally joining said sections together at their adjacent ends for relative angular displacement about a transverse axis closely adjacent said undersurfaces between predetermined first positions with said undersurfaces substantially coplanar and variable second positions with the adjacent portions of said longitudinal undersurfaces defining an included angle greater than 180°, said ski construction including spring means operatively connected between said sections yieldingly biasing said sections from said variable second positions toward said predetermined first positions, binding structure supported from said ski construction and operatively associated with said spring means for flexure thereof to facilitate movement of said ski sections from said predetermined first positions toward said variable second positions in response to shifting of leg weight generally centered on the bottom of a ski boot operatively associated with said binding structure to the toe portion of the ski boot.

9. The combination of claim 7 wherein said spring means comprises an elongated leaf spring which is substantially straight when said sections are in said predetermined first positions and comprises a compression brace between said sections against relative angular displacement thereof from said predetermined first positions toward said variable second positions, said binding structure including a toe portion for underlying an associated ski boot toe and connected to said leaf spring in a manner whereby downward pressure on the ski boot toe may initiate angular displacement of said leaf spring.

10. A ski construction that automatically adjusts to varying surface conditions of ice and snow to prevent rearward movement of the ski during cross-country and uphill skiing, said ski construction including front and rear tandem ski sections having substantially coextensive longitudinal undersurfaces, pivot means pivotally joining said sections together at their adjacent ends for relative angular displacement about a transverse axis closely adjacent said undersurfaces between predetermined first positions with said undersurfaces substantially coplanar and variable second positions with the adjacent portions of said longitudinal undersurfaces defining an included angle greater than 180°, said ski construction including spring means operatively connected between said sections yieldingly biasing said sections from said variable second positions toward said predetermined first positions, said spring means comprising an elongated leaf spring which is substantially straight when said sections are in said predetermined first positions and comprise a compession brace between said sections against relative angular displacement thereof from said predetermined first positions toward said variable second positions, and adjustable abutment structure supported from said ski construction for engagement with said leaf spring and operative to adjustably determine the upward limit of movement of said leaf spring including the capability to initially flex said leaf spring from the straight condition thereof.

11. The combination of claim 10 wherein said ski construction includes ski boot binding structures, said binding structure including a portion thereof for support of the toe portion of an associated ski boot, said portion of said binding being connected to said leaf spring in a manner whereby downward pressure on the ski boot toe may initiate angular displacement of said leaf spring.

12. The combination of claim 11 wherein the forward end portion of the undersurface of the rear ski section is upwardly offset and the undersurface of the rear end of the front ski section defines a rearwardly facing step incorporating a rearwardly and downwardly facing hard, sharp surface for engaging ice and hard snow.

13. A ski construction that automatically adjusts to varying surface conditions of ice and snow to prevent rearward movement of the ski during cross-country and uphill skiing, said ski construction including front and rear tandem ski sections having substantially coextensive longitudinal undersurfaces, pivot means pivotally joining said sections together at their adjacent ends for relative angular displacement about a transverse axis closely adjacent said undersurfaces between predetermined first positions with said undersurfaces substantially coplanar and variable second positions with the adjacent portions of said longitudinal undersurfaces defining an included angle greater than 180°, said ski construction including spring means operatively connected between said sections yieldingly biasing said sections from said variable second positions toward said predetermined first positions, said spring means comprising an elongated leaf spring which is substantially straight when said sections are in said predetermined first positions and comprising a compression brace between said sections against relative angular displacement thereof from said predetermined first positions toward said variable second positions, the upper portions of the adjacent ends of said ski sections being relieved to define an upwardly opening recess bridging the pivotal connection between said ski sections, said spring means comprising an elongated leaf spring having its opposite ends anchored relative to the upper surface portions of said ski sections and its longitudinal midportion spanning said recess and deflectable downwardly into the latter, said ski construction including ski boot binding structure including a portion thereof for support of the toe portion of an associated ski boot, said portion of said boot binding structure being connected to the midportion of said leaf spring deflectable downwardly into said recess.

* * * * *